US007832301B2

(12) United States Patent
Nozue et al.

(10) Patent No.: US 7,832,301 B2
(45) Date of Patent: Nov. 16, 2010

(54) ROTATION MECHANISM FOR CONSTRUCTION MACHINE AND METHOD OF MEASURING BACKLASH IN THE MECHANISM

(75) Inventors: Akiyasu Nozue, Ushiku (JP); Nozomu Tanaka, Tsuchiura (JP); Hiroyuki Isobe, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 657 days.

(21) Appl. No.: 10/551,839

(22) PCT Filed: Apr. 5, 2004

(86) PCT No.: PCT/JP2004/004888

§ 371 (c)(1),
(2), (4) Date: Jun. 20, 2006

(87) PCT Pub. No.: WO2004/090242

PCT Pub. Date: Oct. 21, 2004

(65) Prior Publication Data

US 2007/0034033 A1 Feb. 15, 2007

(30) Foreign Application Priority Data

Apr. 4, 2003 (JP) ..... 2003-101799

(51) Int. Cl.
*F16H 57/02* (2006.01)

(52) U.S. Cl. ..... 74/431; 74/409; 74/440; 212/247

(58) Field of Classification Search ..... 74/409, 74/440, 44, 411, 665 A, 665 B, 421 A, 414, 74/446, 448; 212/253, 181
See application file for complete search history.

(56) References Cited

U.S. PATENT DOCUMENTS 3,972,378 A * 8/1976 Houriez et al. ..... 180/6.58
6,035,736 A * 3/2000 Gyllner et al. ..... 74/397

FOREIGN PATENT DOCUMENTS

JP 09268600 A * 10/1997
JP 2000-336696 A 12/2000
JP 2000336696 A * 12/2000

* cited by examiner

*Primary Examiner*—Richard W L Ridley
*Assistant Examiner*—Thomas Diaz
(74) *Attorney, Agent, or Firm*—Crowell & Moring LLP

(57) ABSTRACT

A swing mechanism for a construction machine is provided with a center frame 3 having a pinion insertion hole 3*c*, an inner race having an internal gear and mounted on a side of an undercarriage, an outer race 1*b* rotatably arranged surrounding the inner race and provided with the center frame secured thereon by bolts 8*a*, a pinion maintained in meshing engagement with the internal gear of the inner race, and a pinion drive device. A pin fit-in hole 3*d* arranged in the center frame 3 such that a knock pin 6 fixed on the outer race 1*b* is fitted in the pin fit-in hole to position the center frame 3. To arrange the pin fit-in hole 3*d* in the center frame 3, a pin fit-in hole portion 20 through which the pin fit-in hole 3*d* is formed is locally arranged such that the pin fit-in hole portion 20 extends toward the pinion insertion hole 3*c* to have a center of the pin fit-in hole 3*d* located on a center connection line S. This construction allows to perform smooth assembly of the pinion drive device while enabling to optimally arrange the knock pin for positioning the center frame.

4 Claims, 5 Drawing Sheets

ROTATION MECHANISM FOR CONSTRUCTION MACHINE AND METHOD OF MEASURING BACKLASH IN THE MECHANISM

TECHNICAL FIELD

This invention relates to a swing mechanism for a construction machine such as a hydraulic excavator or crane, which is provided with a swing frame, an inner race having an internal gear and mounted on a side of a base such as an undercarriage, an outer race rotatably arranged surrounding the inner race and provided with the swing frame secured thereon by bolts, a pinion maintained in meshing engagement with the internal gear of the inner race, and a pinion drive device for rotationally driving the pinion, and also to a method for measuring its backlash.

BACKGROUND ART

Construction machines such as hydraulic excavators include those constructed such that a swing frame and an upperstructure, which is arranged on the swing frame and is composed of various devices, can be caused to swing relative to a base such as an undercarriage. The term "swing mechanism for a construction machine" means a mechanism constructed by arranging a swing frame, an inner annular ring having an internal gear on an inner circumferential portion thereof and mounted on a side of a base, an outer annular ring rotatably arranged surrounding the inner race and provided with the swing frame secured thereon by bolts, a pinion maintained in meshing engagement with the internal gear of the inner race, and a pinion drive device for rotationally driving the pinion such that such an upperstructure is allowed to achieve a swing motion. This pinion drive device serves as a drive source for causing the upperstructure to swing relative to the base, and in general, is equipped with a motor such as a hydraulic motor and a reduction gear box for transmitting rotation of the motor at a reduced speed to a pinion and is arranged on the side of the swing frame.

A swing mechanism for a construction machine is designed such that a pinion on the side of a swing frame is brought into meshing engagement with an internal gear of an inner race on the side of an undercarriage to permit swinging of the swing frame, which forms an upperstructure, relative to a base. It is, therefore, necessary to maintain the pinion and the inner gear in adequate meshing engagement so that the upperstructure does not shake upon swinging. When plural hydraulic excavators are assembled, however, a backlash formed at a place of meshing engagement between a rotating pinion and a ring gear on an inner race of a swing circle in each swing mechanism substantially varies from one swing mechanism to another, resulting in a problem that the hydraulic excavators tend to be reduced in quality.

To cope with such a problem, an invention disclosed, for example, in Patent Publication 1 has been proposed. In a mounting structure for a swing unit that the mounting structure is arranged on a construction machine equipped with a traveling unit and the swing unit arranged on the traveling unit via a swing circle having an inner race and outer race, the swing unit having a rotational pinion is secured by bolts on a main frame of the swing unit, the outer race of the swing circle is secured by bolts on the main frame of the swing unit, the inner race of the swing circle is secured by bolts on the traveling unit, and the swing unit is arranged to maintain the inner race of the swing circle in meshing engagement with a ring gear of the inner race of the swing circle, the invention is characterized in that at least one of a single pin for the swing unit, said single pin connecting the swing unit to the main frame, and a single pin for the swing circle, said pin connecting the outer race of the swing circle to the main frame, is arranged and at least one of a pin for the swing unit and a pin for the swing circle is arranged on a center connecting line, which connects a center of the above-described swing circle and a center of the swing unit with each other, or in the vicinity of the center connecting line.

Patent Publication 1: JP-A-2000-336696 (pages 3-5, FIGS. 1-2).

DISCLOSURE OF THE INVENTION

The existence of a backlash between an inner gear of an inner race and a pinion causes a front on a swing frame to shake, and hence, leads to a reduction in the working accuracy. When a swing frame, for example, in a hydraulic shovel rattles during digging operation by a bucket, vibrations are transmitted to the bucket via a boom and arm. To the bucket located far apart from the center of its swinging motion, the vibrations are transmitted in a magnified state, thereby causing the bucket to shake to unexpected large extent and reducing the accuracy of the digging work. It is, therefore, desired to fix a center frame and a pinion drive device at appropriate locations such that the backlash between the inner gear and the pinion is minimized as much as possible. Especially in recent years, it is demanded to reduce such a backlash to a minimum need such that a construction machine is improved in the working accuracy or in the comfort of use.

In this respect, a description will be made about a conventional swing mechanism for a construction. A pinion drive device is designed to be positioned on a center frame at two locations by two knock pins 7, the pinion drive device can be always fixed at an appropriate location. The center frame 3 is in turn designed to be positioned on an outer race by only one knock pin 6. Whenever the center frame 3 is positioned, the center frame 3 is displaced by a difference in diameter between bolt insertion holes of the outer race 1*b* and bolts 8*a* such that the center frame 3 rocks about the knock pin 6. This knock pin 6 is secured at a location substantially far from a center connection lines. When the center frame 3 rocks about the knock pin 6, a center $O_1$ of a swing circle 1 may, therefore, be shifted to an unnegligible extent from the optimal location in a direction of arrow Y along the center connection line S.

To resolve such a problem, it is only necessary to secure the center-frame-positioning knock pin 6 around the center connection line S. This positioning, however, involves a difficulty from the practical viewpoint, because in relation to the modules, tooth numbers and the like of the internal gear and a pinion 4, a bracket for mounting the pinion drive device is generally arranged astride the outer race so that the center frame does not have any sufficient space for the arrangement of the knock pin. If the diameter of the pinion insertion hole is reduced to increase this space, a great deal of labor is required to insert the pinion and its peripheral elements into the pinion insertion hole without any interference with the circumferential edge portion of the hole upon assembling the pinion drive device, thereby making it impossible to smoothly perform the assembly of the pinion drive device.

When an attempt is made to reduce a backlash, it is impossible to determine how much the backlash has been reduced unless the amount of the backlash is known. Accordingly, there is also a desire for the development of a technique that makes it possible to determine the amount of a backlash and then, to determine whether or not it is an appropriate amount.

The present invention has been completed to resolve such problems, and has as an object the provision of a swing mechanism for a construction machine, which can smoothly perform the assembly of a pinion drive device while enabling optimal arrangement of a swing frame-positioning knock pin.

Another object of the present invention is to provide a method for measuring a backlash in a swing mechanism for a construction machine, which can surely determine the amount of a backlash and also to determine whether or not the amount of the backlash is adequate.

To achieve the above-described objects, the present invention is characterized in that in a swing mechanism for a construction machine, said swing mechanism being provided with a swing frame, an inner race having an internal gear on an inner circumferential portion thereof and mounted on a side of a base, an outer race rotatably arranged surrounding the inner race and provided with the swing frame mounted thereon, a pinion inserted through a pinion insertion hole formed in the swing frame and maintained in meshing engagement with the internal gear, a pinion drive device for rotationally driving the pinion, and a pin fit-in hole arranged in the swing frame such that a knock pin fixed on the outer race is fitted in the pin fit-in hole to position the swing frame, a pin fit-in hole portion through which the pin fit-in hole is formed is arranged on the swing frame at a location in a vicinity of a place of meshing engagement between the pinion and the internal gear such that the pin fit-in hole portion extends toward the pinion insertion hole, and the pin fit-in hole is located on or in a vicinity of a line that extends through a center of rotation of the outer race and a center of rotation of the pinion.

In the above-described swing mechanism, it is preferred to arrange the knock pin for positioning the pinion drive device between the swing frame and the pinion drive device and to locate a center of the knock pin for positioning each of the swing frame, said knock pin being fitted in the pin fit-in hole, and a center of a knock pin for positioning the pinion drive on or in a vicinity of a line that extends through the center of rotation of the outer race and the center of rotation of the pinion. The pin fit-in hole can be arranged in a center frame of the swing frame, and the fit-in hole in which the knock pin for positioning the pinion drive device is fitted can be arranged through a flange portion of the pinion drive device and a bracket for mounting the pinion drive device.

A second aspect is characterized in that in a method for measuring a backlash of a swing mechanism for a construction machine, said swing mechanism being provided with a swing frame, an inner race having an internal gear on an inner circumferential portion thereof and mounted on a side of a base, an outer race rotatably arranged surrounding the inner race and provided with the swing frame mounted thereon, a pinion inserted through a pinion insertion hole formed in the swing frame and maintained in meshing engagement with the internal gear, a pinion drive device for rotationally driving the pinion, and a pin fit-in hole arranged in the swing frame such that a knock pin fixed on the outer race is fitted in the pin fit-in hole to position the swing frame, a distance between a center of the knock pin for positioning the swing frame, said knock pin being fitted in the pin fit-in hole, and a center of a knock pin arranged between the swing frame and the pinion drive device to position the pinion drive device is measured, a distance between a center of rotation of the outer race and a center of rotation of the pinion is calculated from the distance so measured, and the backlash to be formed after assembly of the swing mechanism is determined from the distance so calculated.

In the above-described method, it is possible to determine, from the backlash so determined, whether or not the backlash after the assembly of the swing mechanism falls within a tolerance range.

The swing mechanism according to the present invention for the construction machine has made it possible to optimally arrange the swing frame-positioning knock pin, because a pin fit-in hole portion is arranged on the swing frame at a location in the vicinity of the place of meshing engagement between the pinion and the internal gear such that the pin fit-in hole portion extends toward the pinion insertion hole and the pin fit-in hole is located around the line that extends through the center of rotation of the outer race and the center of rotation of the pinion. As a result, the backlash between the internal gear of the inner race and the swing circle-driving pinion can be reduced to a minimum need.

Nonetheless, the pinion insertion hole is not substantially reduced because the pin fit-in hole portion is arranged only locally although it extends toward the pinion insertion hole. Owing to this feature, the labor required for the insertion of the pinion and its peripheral elements upon assembling the pinion drive device is not practically different from the past although it is necessary to insert them without any interference with the pin fit-in hole portion. With the swing mechanism according to the present invention for the construction machine, it is possible not only to make feasible the optimal arrangement of the swing frame-positioning knock frame but also to smoothly conduct the assembly of the pinion drive device as before.

Moreover, the distance between the center of swinging and that of rotation can be precisely calculated through conversion by measuring the distance between both the knock pins. As a result, it is possible to efficiently inspect with good accuracy whether or not the backlash after the assembly of the swing mechanism falls within a tolerance range.

As has been described above, the swing mechanism according to the present invention for the construction machine makes it possible smoothly perform the assembly of the pinion drive device while permitting the optimal arrangement of the swing frame-positioning knock pin. In addition, the swing mechanism according to the present invention for the construction machine can achieve the optimal arrangement of the swing frame-positioning knock pin so that the backlash between the internal gear of the inner race and the swing circle-driving pinion can be reduced to a minimum need. This makes it possible to improve the working accuracy of the construction machine and also to improve the comfort of use of the construction machine. Furthermore, it is also possible to efficiently determine with good accuracy whether or not the backlash after the assembly of the swing mechanism falls within a tolerance range.

BEST MODE FOR CARRYING OUT THE INVENTION

With reference to the drawings, a description will hereinafter be made about a best mode for carrying out the present invention.

Figure 5:
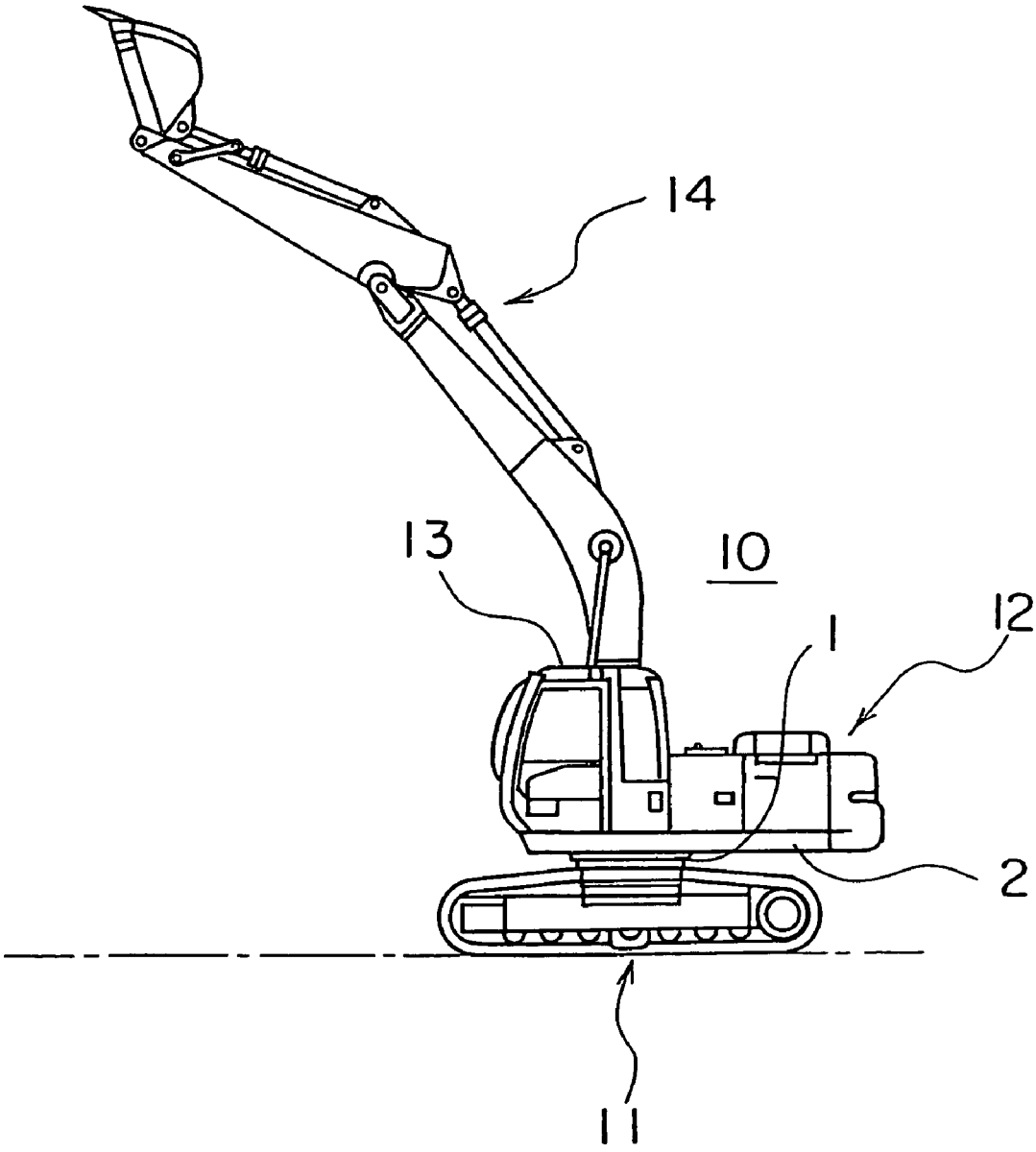
FIG. 5 is a side view of a hydraulic excavator as one example of the construction machine.

Firstly, the overall construction of the hydraulic excavator mentioned as an illustrative construction machine will be outlined based on FIG. 5.

Depicted are a mobile hydraulic excavator 10 that travels at a work site to perform various work such as digging work and loading work of excavated earth or sand, an undercarriage 11 of the mobile hydraulic excavator 10, said undercarriage serving as a base for mounting thereon an upperstructure 12 and being capable of travelling by crawlers, the upper structure 12 composed of a swing frame 2 and various devices arranged thereon and supported swingably relative to the undercarriage 11 via a swing circle 1, an operator's cab 13 in which an operator performs operations of a front 14 and the like, and the front 14 serving as a working section of the hydraulic excavator 10.

Arranged on the swing frame 2 are a pinion drive device to be described subsequently herein and a variety of devices or elements such as the operator's cab 13, an engine compartment, a counterweight, and the like. The upperstructure 12 is a generic term for the assembly of these various devices or elements and the swing frame 2. The front 14 of the hydraulic excavator 10 is composed of a boom, an arm, a bucket and the like, and is arranged on a right front pat of the upperstructure 12 in a selectively raisable or lowerable fashion. The swing circle 1 and swing frame 2 will be described in detail subsequently herein.

Referring to FIGS. 1 through 5, a description will next be made about the details of the swing mechanism for the construction machine and a method of its assembly.

In these drawings, the swing frame 1 is composed by arranging an inner race 1*a*, an outer race 1*b* and rolling elements 1*c*, and supports the upperstructure 12 swingably relative to the undercarriage 11. The inner race 1*a* is provided on an inner circumferential portion thereof with an internal gear (ring gear) and is mounted on the side of the undercarriage 11. The outer race 1*b* is formed in an annular shape, and is rotatably arranged such that it concentrically surrounds the inner race 1*a*. The swing frame 2 is secured on the inner race 1*a* by bolts 8*a*. The rolling elements 1*c* are accommodated within an annular space between an outer circumferential wall of the inner race 1*a* and an inner circumferential wall of the outer race 1*b*, and have the function of a bearing. The swing frame 2 serves as a base for the upperstructure 12, and is swingably mounted on the undercarriage 11. A center frame 3 makes up a central part of the swing frame 2, and is swingably mounted on the undercarriage 11 via the swing circle 1. A bracket 3*a* is welded on the center frame 3, and is an annular bracket on which the pinion drive device 5 is secured by bolts 8*b*.

Figure 1:
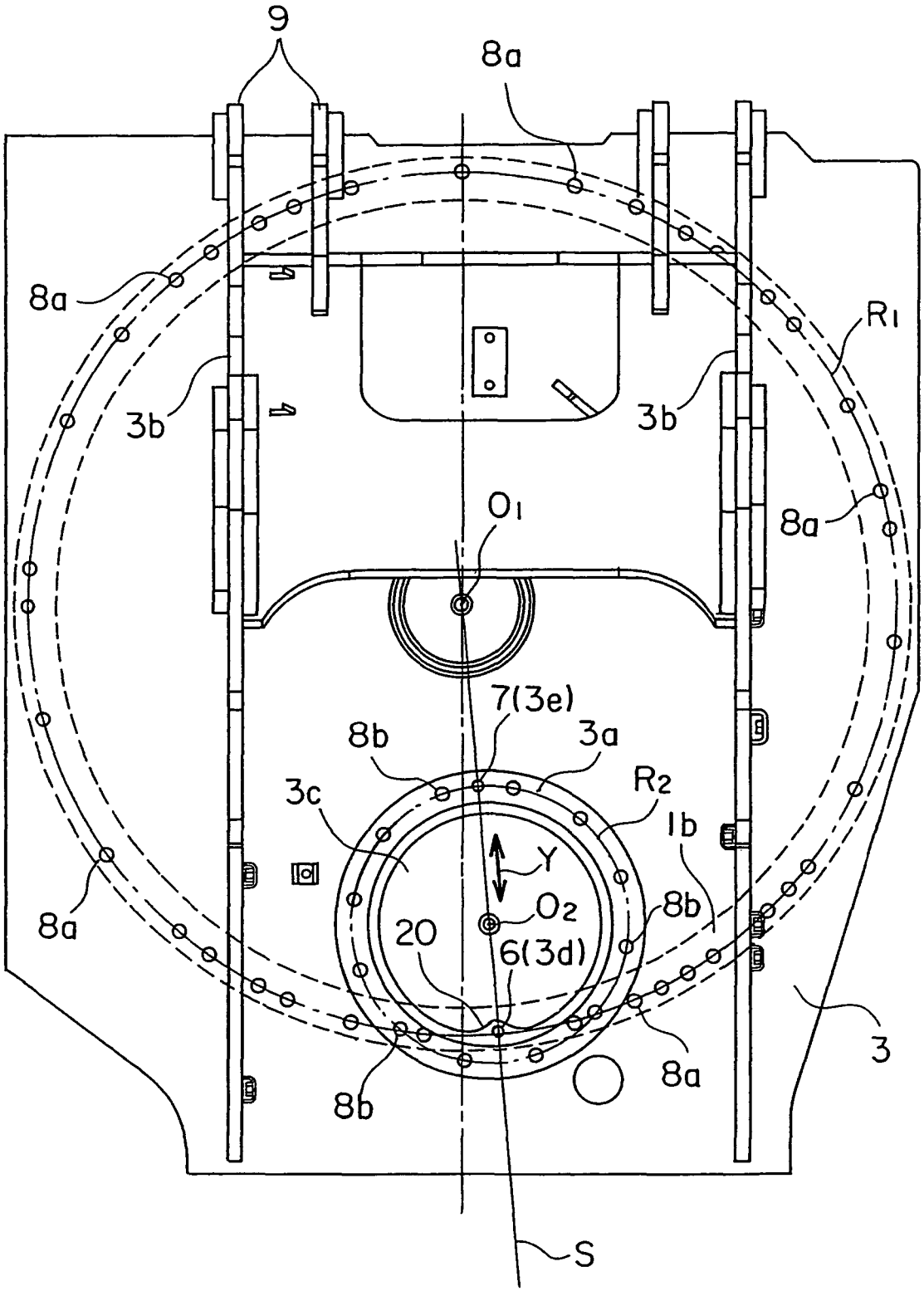
FIG. 1 is a fragmentary plan view of a swing mechanism according an embodiment of the present invention for a construction machine.
Figure 2:
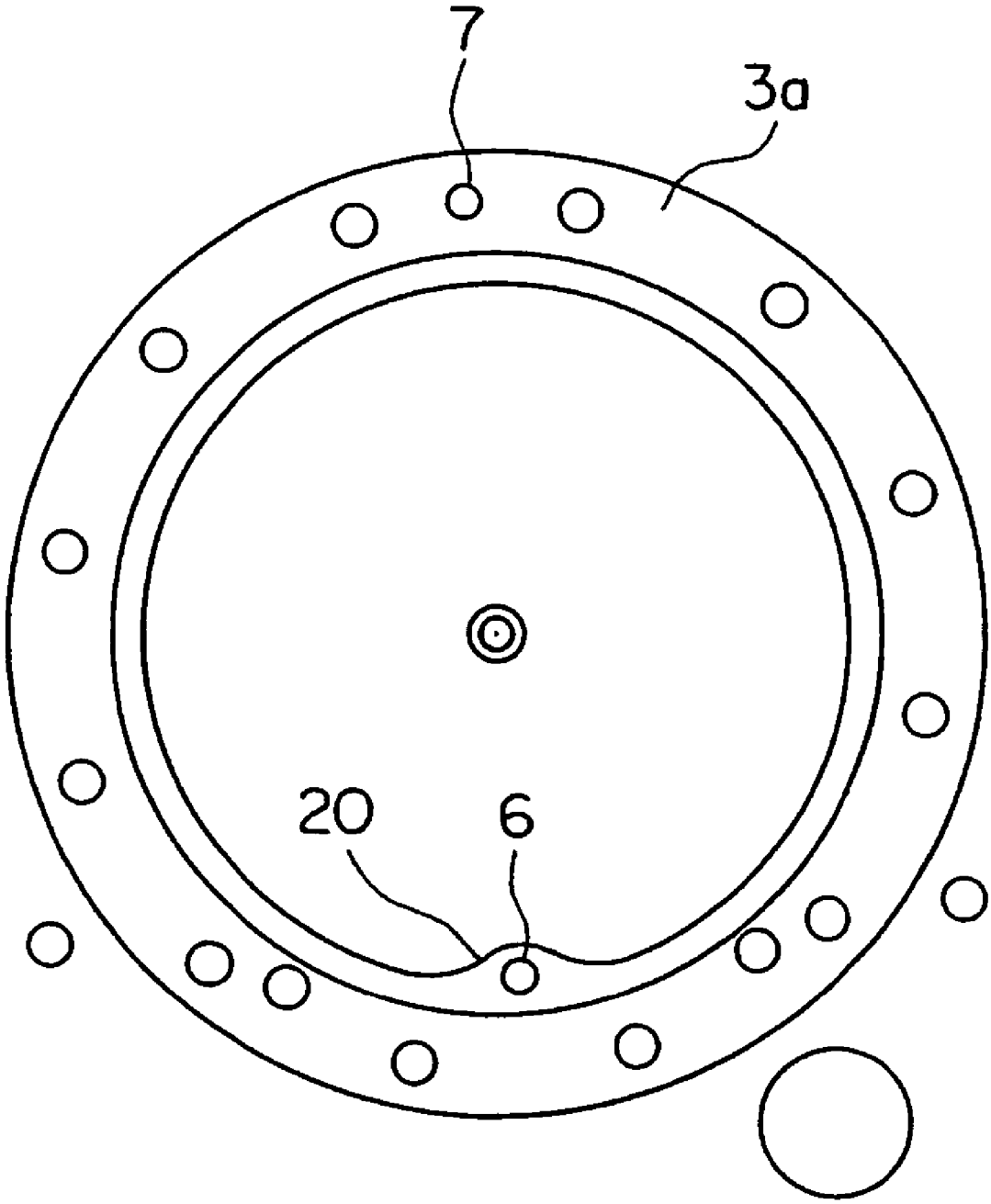
FIG. 2 is a plan view showing on an enlarged scale a bracket for mounting a pinion drive device and its adjacent elements in FIG. 1.
Figure 3:
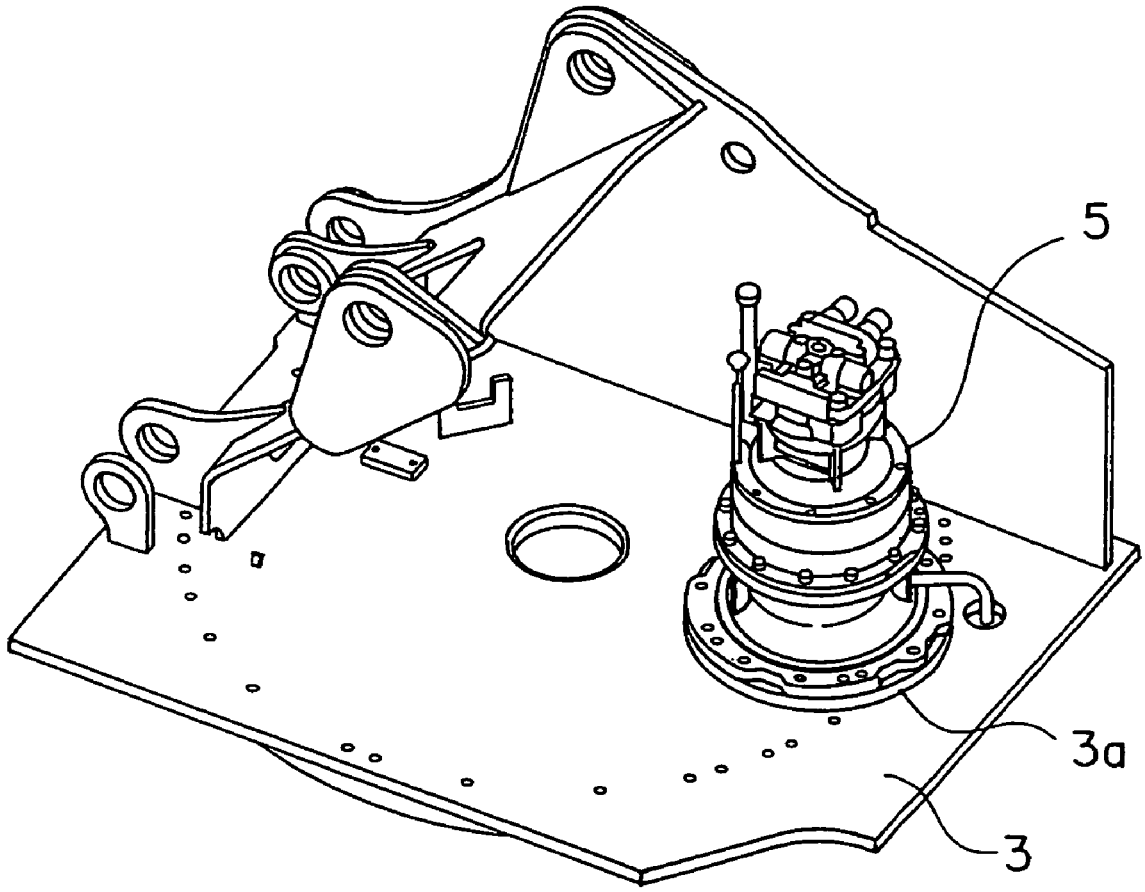
FIG. 3 is a fragmentary perspective view of a swing mechanism according the embodiment of the present invention for the construction machine.
Figure 4:
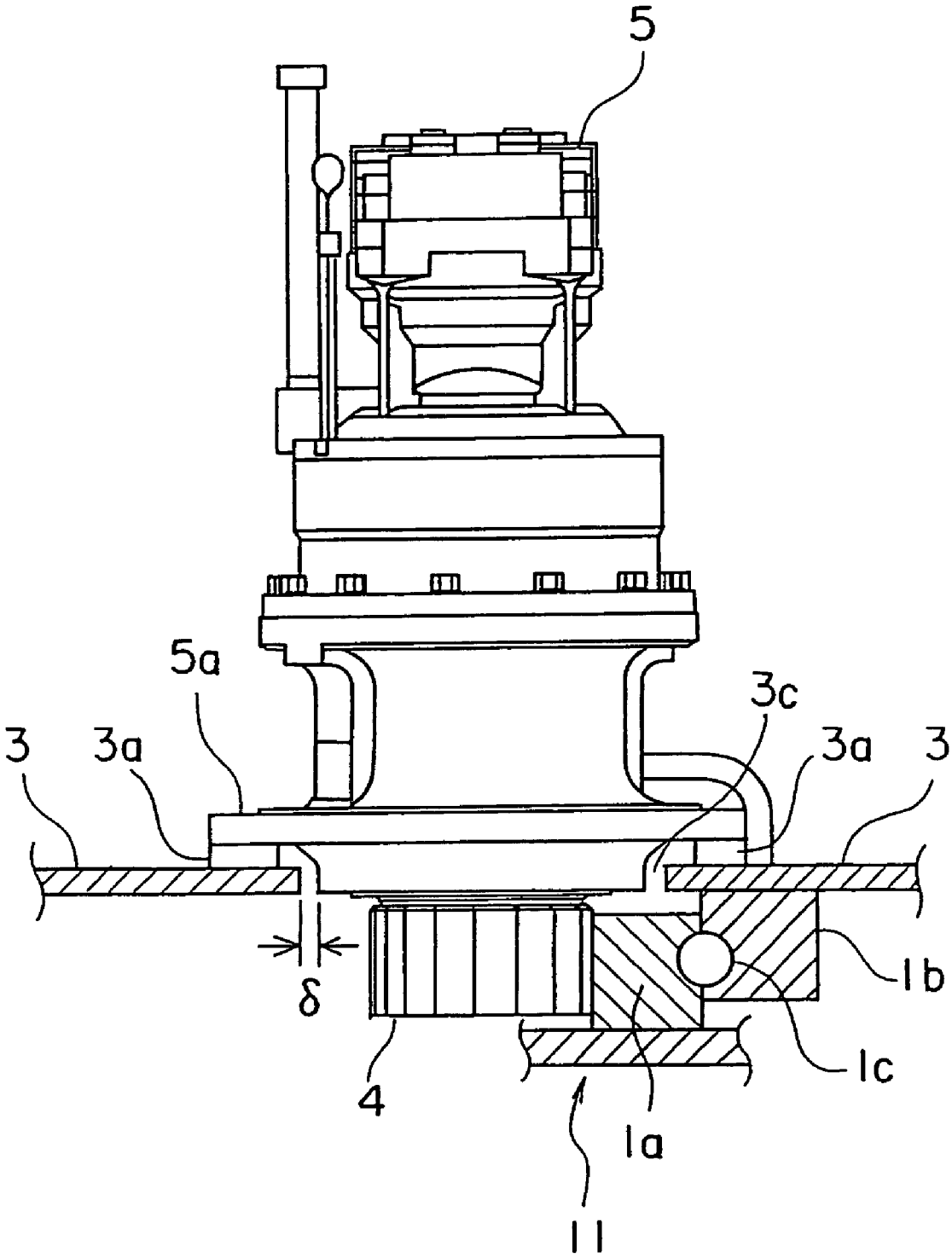
FIG. 4 is a side view of the pinion drive device and its peripheral elements of FIG. 3 in the swing mechanism for the construction machine, and illustrates a swing circle and its adjacent elements in cross-section.

By accommodating the rolling elements 1*c* within the annular space between the inner race 1*a* and the outer race 1*b*, the swing circle 1 is integrally united via the rolling elements 1*c* such that the swing circle 1 is prevented from falling apart. As illustrated in FIG. 4, the inner race 1*a* is fastened by unillustrated bolts and nuts on the undercarriage 11 so that the swing circle 1 constructed as described above is fixed at a specified position on the undercarriage 11. The bolts 8*a* are inserted through the outer race 1*b* of the thus-fixed swing circle 1 and are then tightened to fix the center frame 3 at a specified position on the outer race 1*b*. Therefore, the outer race 1*b* is provided with many bolt insertion holes of a somewhat greater diameter than the bolts 8*a* (not illustrated) on a preset pitch circle. Corresponding to these holes, the center frame 3 is provided with many bolt holes (their sign is omitted as they are holes located at the same locations as the bolts 8*a*), in which the bolts 8*a* are threaded, on a preset pitch circle $R_1$ as shown in FIG. 1.

In the illustrated embodiment, the swing frame 2 is composed of the center frame 3 and left and right side frames (not shown) on opposite sides of the center frame 3. On the center frame 3, a pair of vertical plates 3*b* are arranged upright such that they extend in a front-to-rear direction at a predetermined interval therebetween. The vertical plates 3*b* reinforce the center frame 3 to withstand forces applied from the front 14. In the center frame 3, a pinion insertion hole 3*c* is also formed to permit the insertion of the pinion 4, which serves to drive the swing circle and is to be described subsequently herein, such that the pinion is brought into meshing engagement with the internal gear of the ring 1*a*. As depicted in FIG. 4, the pinion insertion hole 3*c* is formed with a slightly larger diameter (as much as δ) than the circumferential portion of the pinion to permit smooth assembly work of the pinion 4. The bracket 3*a* for mounting the pinion drive device has been formed by bending a single bar-like plate into a circular form.

The swing circle-driving pinion 4 is maintained in meshing engagement with the internal gear of the inner race 1*a*, and is rotationally driven by the pinion drive device 5. A knock pin 6 for positioning the pinion drive device serves to position the pinion drive device 5 relative to the center frame 3. The bolts 8*a* serve to threadedly fasten the center frame 3 on the outer race 1*b*, the bolts 8*b* serve to threadedly fasten the pinion drive device 5 on the bracket 3*a* of the center frame 3, and the bracket 9 serves to secure the boom of the front 14 tiltably up and down.

The pinion drive device 5 is provided with a hydraulic motor and a reduction gear box or the like arranged below the hydraulic motor to reduce its rotation, and is accommodated within a housing. A power output shaft of the reduction gear box is connected to the pinion 4. The pinion drive device 5 is fixed at a specified location on the center frame 3 by threadedly fastening it with the bolts 8*b* to the bracket 3*a* on the center frame 3 positioned and fixed on the outer race 1*b*. For this purpose, the flange portion 5*a* of the pinion drive device 5 is provided with many bolt insertion holes (not illustrated), which permit the insertion of the bolts 8*b* therethrough and are of a somewhat larger diameter than the bolt 8*b*, on a preset pitch circle. Corresponding to these holes, the bracket 3*a* for mounting the pinion drive device is provided with many bolt holes (their sign is omitted as they are holes located at the same locations as the bolts 8*b*), in which the bolts 8*b* are threaded, on a preset pitch circle $R_2$ as shown in FIG. 1.

It is to be noted that upon designing the internal gear of the inner race 1*a* and the teeth of the pinion 4, the teeth are underdimensioned beforehand to provide a predetermined amount of backlash (an inter-tooth play produced when the internal gear of the inner race 1*a* and the pinion 4 are brought into meshing engagement) at a place of meshing engagement between them for the purpose of preventing that the internal gear and the pinion 4 fit excessively tight with each other and the pinion 4 becomes no longer rotatable or for the purpose of absorbing dimensional errors of the internal gear and pinion 4 that unavoidably arise upon their fabrication. Unless the swing circle 1 and pinion 4 are accurately positioned and fixed at appropriate locations upon assembling them, an unnecessarily large backlash is produced so that the upper-structure 12 shakes upon swinging.

On the other hand, the center frame 3 is fixed on the outer race 1*b* by inserting the bolts 8*a* through the bolt insertion holes, which are larger in diameter than the bolts 8*a* and are formed through the outer race 1*b*. As there is a difference in diameter between these holes and the bolts 8*a*, a variation arises as much as the diametrical difference in the backlash at the place of meshing engagement between the internal gear of the inner race 1*a* and the pinion 4 depending on the state of mounting of the center frame 3. Further, the flange portion 5*a* of the pinion drive device 5, said flange portion 5*a* being fixed on the center frame 3 by the bolts 8*a*, is also provided with the bolt insertion holes of a somewhat greater diameter than the bolt 8*b*, so that there is a difference in diameter between these holes and the bolts 8*b*. A variation, therefore, arises as much as the diametrical difference in the backlash at the place of meshing engagement between the internal gear and the pinion 4 depending on the state of mounting of the pinion drive device 5.

The center-frame-positioning knock pin 6 and pinion-drive-device-positioning knock pin 7 are arranged to position the center frame 3 and pinion drive device 5 at locations as appropriate as possible relative to the outer race 1*b* and center frame 3, respectively, so that the pinion drive device 5 is positioned at a location as appropriate as possible relative to the swing circle 1 to reduce the variation in the backlash at the place of meshing engagement between the internal gear of the inner race 1*a* and the pinion 4. The internal gear of the inner race 1*a* and the pinion 4 are brought into meshing engagement on a center connection line S, which extend through a center $O_1$ of the swing circle 1 (the center of rotation of the outer race 1*b*) and a center $O_2$ of the pinion drive device 5 (the center of rotation of the pinion 4). To make the backlash at the place of meshing engagement between both the gears closer to an optimal value set from the designing standpoint, it is necessary to prevent movement of the positions of the centers $O_1$,$O_2$ from the optimal positions in a direction of arrow Y along the center connection line S.

For the purpose of providing a pin fit-in hole 3*d* with the center frame 3 to position the center frame 3 by fitting the center-frame-positioning knock pin 6, a pin fit-in hole portion 20, through which the pin fit-in hole 3*d* is formed, is formed extending toward the pinion insertion hole 3*c* in the swing mechanism for the construction machine. The pin fit-in hole portion 20 is arranged locally on the center frame 3 at a location in the vicinity of the place of meshing engagement between the internal gear of the inner race 1*a* and the pinion 4, and the pin fit-in hole 3 is arranged through the extended portion. In the illustrated embodiment, the center of the pin fit-in hole 3*d* is designed to be positioned on the center connection line S, which extends through the center $O_1$ rotation of the outer race 1*b* and the center $O_2$ of rotation of the pinion 4. To arrange the pin fit-in hole portion 20 on the center frame 3, the pin fit-in hole portion 20 is formed integrally with the center frame 3 upon forming the pinion insertion hole 3*c*.

On the other hand, the knock pin 7 is arranged at one location on the pitch circle $R_2$ to position the pinion drive device 5 relative to the center frame 3. For this purpose, a pin fit-in hole (not illustrated) in which the knock pin 7 is fitted is arranged in the flange portion 5*a* of the pinion drive device 5, and further, a pin fit-in hole 3*e* is arranged in the pinion-drive-device-mounting bracket 3*a* such that the knock pin 7 is fitted in these pin fit-in hole to position the pinion drive device 5. This pin fit-in hole 3*e* is arranged such that its center is positioned on the center connection line S.

Upon assembling the above-described swing mechanism for the construction machine, the inner race 1*a* of the swing circle 1 is firstly fastened by bolts and nuts to a member on the side of the undercarriage 11 to fix the swing circle 1 at the specified location on the undercarriage 11 and also to fix the center-frame-positioning knock pin 6 on the outer race 1*b* of the swing circle 1. After the center frame 3 is suspended and lowered such that the knock pin 6 is fitted in the pin fit-in hole 3*d* of the center frame 3 to position the center frame 3, the center frame 3 is secured on the outer race 1*b* by the bolts 8*a*. The pinion fit-in hole arranged in the flange portion 5*a* of the pinion drive device 5 is then brought into registration with the pin fit-in hole 3*e* of the pinion-drive-device-mounting bracket 3*a*. Thereafter, the knock pin 7 is fitted in the pin fit-in hole of the flange portion 5*a* and the pin fit-in hole 3*e* of the bracket 3*a* to position the pinion drive device 5, and the flange portion 5*a* of the pinion drive device 5 is secured on the center frame 3 by the bolts 8*b*.

In the swing mechanism for the construction machine, the pin fit-in hole portion 20 is arranged on the center frame 3 at the location in the vicinity of the place of meshing engagement between the internal gear of the inner race 1*a* and the pinion 4 such that the pin fit-in hole portion 20 extends toward the pinion insertion hole 3*c*, and the pin fit-in hole 3*d* is designed to be positioned on the center connection line S which extends through the center $O_1$ rotation of the outer race 3*b* and the center $O_2$ of rotation of the pinion 4. It is, therefore, possible to optimally arrange the center-frame-positioning knock pin 6. As a result, the backlash between the internal gear of the inner race 1*a* and the swing circle-driving pinion 4 can be reduced to a minimum need.

As the pin fit-in hole portion 20 is arranged only locally although it extends toward the pinion insertion hole 3*c*, the size of the pinion insertion hole 3*c* is not substantially reduced. Upon assembling the pinion drive device 5, the labor required for its insertion is, therefore, not substantially different from the conventional swing mechanism although it is necessary to insert the pinion 4 and its peripheral elements without any interference with the pin fit-in hole portion 20. With the swing mechanism for the construction machine, it is, therefore, possible not only to optimally arrange the center-frame-positioning knock pin 6 but also to perform the assembly of the pinion drive mechanism 5 smoothly as before.

The swing mechanism for the construction machine enables the optimal arrangement of the center-frame-positioning knock pin 6 so that the backlash between the internal gear of the inner race 1*a* and the swing circle-driving pinion 4 can be reduced to a minimum need. It is, therefore, possible to improve the working accuracy of the construction machine and also to improve the comfort of use of the construction machine. In the illustrated embodiment, for the purpose of arranging the pin fit-in hole portion 20 on the center frame 3, the pin fit-in hole portion 20 is formed integrally with the center frame 3 especially upon formation of the pinion insertion hole 3*c* to arrange it on the center frame 3. Owing to the arrangement of the pin fit-in hole portion 20, the machining steps for the swing mechanism for the construction machine are not complicated.

The backlash between the internal gear of the inner race 1*a* and the pinion 4 fluctuates to develop a variation depending on the machining accuracy and assembling accuracy of the swing mechanism of the construction machine. It is, therefore, desired to inspect with good accuracy whether or not the backlash after the assembly of the swing mechanism falls within a preset tolerance range. This backlash can be calculated based on the distance between the center $O_1$ of swinging of the swing circle 1 and the center $O_2$ of the pinion 4.

However, it has heretofore been difficult to measure with good accuracy the backlash after the assembly of the swing mechanism because the actual locations of the center $O_1$ of swinging and the center $O_2$ of rotation cannot be determined. In the illustrated embodiment, however, the distance between the center $O_1$ of swinging and the center $O_2$ of rotation can be precisely calculated through conversion by measuring the distance between the knock pins 6 and 7 because the pinion-drive-device-positioning knock pin 7 is also arranged at one location like the center-frame-positioning knock pin 6 to have the centers of both the knock pins 6,7 positioned on the center connection line S which lies on a line that extends through the center $O_1$ of swinging and the center $O_2$ of rotation. It is, therefore, possible to efficiently inspect with good accuracy whether or not the backlash after the assembly of the swing mechanism falls within the tolerance range.

In the illustrated embodiment, it is designed especially that the center of the pin fit-in hole 3*e* is positioned on the center connection line S. The pin fit-in hole 3*e* may, however, be arranged at a location adjacent to the center connection line S, and in essence, the desired objects can be achieved if the pin fit-in hole 3*e* is designed to be positioned in the vicinity of the center connection line S.

The invention claimed is:

1. A swing mechanism for a construction machine, said swing mechanism being provided with:

a swing frame, an inner race having an internal gear on an inner circumferential portion thereof and mounted on a side of an undercarriage, an outer race rotatably arranged surrounding said inner race and provided with said swing frame mounted thereon, a pinion inserted through a pinion insertion hole formed in said swing frame and maintained in meshing engagement with said internal gear, a pinion drive device for rotationally driving said pinion, and a pin fit-in hole arranged in said swing frame such that a knock pin fixed on said outer race is fitted in said pin fit-in hole to position said swing frame, wherein a pin fit-in hole portion through which said pin fit-in hole is formed extends so as to bulge radially inwardly and is arranged on said swing frame at a location in a vicinity of a place of meshing engagement between said pinion and said internal gear such that said pin fit-in hole portion extends toward said pinion insertion hole, and said pin fit-in hole is located on a line that extends through a center of rotation of said outer race and a center of rotation of said pinion.

2. A swing mechanism according to claim 1, wherein:

another knock pin for positioning said pinion drive device is arranged between said swing frame and said pinion drive device, and a center of said knock pin for positioning said swing frame, said knock pin being fitted in said pin fit-in hole, and a center of a knock pin for positioning said pinion drive device are each located on a line that extends through said center of rotation of said outer race and said center of rotation of said pinion.

3. A swing mechanism according to claim 2, wherein:

said pin fit-in hole is arranged in a center frame of said swing frame.

4. A swing mechanism according to claim 2, wherein a pin fit-in hole in which said another knock pin for positioning said pinion drive device is fitted is arranged through a flange portion of said pinion drive device and a bracket for mounting said pinion drive device.

* * * * *